US011313151B2

(12) United States Patent
Pfunder

(10) Patent No.: US 11,313,151 B2
(45) Date of Patent: Apr. 26, 2022

(54) SENSOR FOR RIM LATCH ROLLER STRIKE

(71) Applicant: Schlage Lock Company LLC, Carmel, IN (US)

(72) Inventor: Dan Pfunder, Noblesville, IN (US)

(73) Assignee: Schlage Lock Company LLC, Carmel, IN (US)

( * ) Notice: Subject to any disclaimer, the term of this patent is extended or adjusted under 35 U.S.C. 154(b) by 427 days.

(21) Appl. No.: 15/848,299

(22) Filed: Dec. 20, 2017

(65) Prior Publication Data

US 2019/0186170 A1 Jun. 20, 2019

(51) Int. Cl.

| | |
|---|---|
| ***E05B 47/00*** | (2006.01) |
| ***E05B 39/00*** | (2006.01) |
| ***E05B 65/10*** | (2006.01) |
| ***E05B 17/22*** | (2006.01) |

(52) U.S. Cl.

CPC ..... *E05B 47/0046* (2013.01); *E05B 17/22* (2013.01); *E05B 39/00* (2013.01); *E05B 65/1053* (2013.01); *E05B 2047/0069* (2013.01)

(58) Field of Classification Search

None

See application file for complete search history.

(56) References Cited

U.S. PATENT DOCUMENTS 3,751,088 A * 8/1973 Schlage ..... E05B 47/0002 292/201
4,148,001 A * 4/1979 Gwozdz ..... E05D 11/00 200/61.7
4,296,957 A * 10/1981 Belles ..... E05B 17/22 292/264
4,519,640 A * 5/1985 Mombelli ..... E05B 65/1046 292/33

(Continued)

FOREIGN PATENT DOCUMENTS

WO 2015175697 A1 11/2015

OTHER PUBLICATIONS

Definition of "align" from Merriam-Webster's Dictionary, https://www.merriam-webster.com/ (Year: 2020).*

(Continued)

*Primary Examiner* — Alyson M Merlino
(74) *Attorney, Agent, or Firm* — Taft Stettinius & Hollister LLP

(57) ABSTRACT

A locking device assembly for a door located at a door frame. The locking device assembly includes a door strike assembly including a magnetized ferromagnetic material and a latchbolt assembly located at the door. The latchbolt assembly includes a latchbolt and a magnetic field sensor, wherein the magnetic field sensor senses a magnetic field provided by the door strike assembly. The door strike assembly includes, in different embodiments, a magnet located in a frame of the door strike assembly or a magnetic (Continued)

roller. The magnetic field sensor includes a magnetometer configured to determine the presence of a magnetic field provided by the door strike assembly. In the event that the door strike assembly has been removed to defeat the locking device, the lack of the magnetic field indicates that a security condition exists. An alert is provided to indicate the existence of the security condition.

22 Claims, 7 Drawing Sheets

(56) References Cited

U.S. PATENT DOCUMENTS

| | | | | |
|---|---|---|---|---|
| 4,573,720 | A * | 3/1986 | Nicolai | E05B 47/00 292/144 |
| 6,318,138 | B1 | 11/2001 | Mathews et al. | |
| 7,469,942 | B2 * | 12/2008 | Whitaker | E05B 65/108 292/92 |
| 7,486,183 | B2 * | 2/2009 | Luebke | G08B 13/19636 340/506 |
| 8,495,836 | B2 | 7/2013 | Lowder et al. | |
| 8,764,071 | B2 | 7/2014 | Lanigan et al. | |
| 8,820,803 | B2 | 9/2014 | Hunt et al. | |
| 2004/0207210 | A1 * | 10/2004 | Luker | E05B 47/0012 292/144 |
| 2005/0044908 | A1 | 3/2005 | Min | |
| 2011/0291848 | A1 * | 12/2011 | Burdenko | E05C 19/16 340/665 |
| 2012/0167646 | A1 * | 7/2012 | Sharma | E05B 17/22 70/280 |
| 2013/0049380 | A1 * | 2/2013 | Armari | E05B 47/0047 292/163 |
| 2014/0266687 | A1 * | 9/2014 | Britton | H04Q 9/00 340/539.1 |
| 2014/0292001 | A1 | 10/2014 | Nunez et al. | |
| 2015/0159401 | A1 * | 6/2015 | Patrick | G10L 17/22 292/137 |
| 2016/0027272 | A1 * | 1/2016 | Carlson | G01R 33/0023 340/551 |
| 2016/0115712 | A1 * | 4/2016 | Maeng | E05B 45/06 324/207.22 |
| 2016/0189531 | A1 * | 6/2016 | Modi | G08B 13/08 340/506 |
| 2016/0290005 | A1 * | 10/2016 | Goldenson | E05B 47/0038 |
| 2017/0002586 | A1 * | 1/2017 | Lee | E05B 39/00 |
| 2017/0101806 | A1 * | 4/2017 | Iske | E05B 39/00 |
| 2018/0245375 | A1 * | 8/2018 | Arlinghaus | E05B 65/108 |

OTHER PUBLICATIONS

"Von Duprin® Parts Manual: 98/99 Series Rim Exit Devices", Document No. PM9899_C: VD-GN-1029; Publication Date: Jun. 2005; Author: Ingersoll-Rand.

* cited by examiner

SENSOR FOR RIM LATCH ROLLER STRIKE

TECHNICAL FIELD

The present invention generally relates to locking devices, and more particularly, but not exclusively to, a pushbar-type locking device.

BACKGROUND

Commercial or public buildings are typically required by law to provide for an emergency exit in case of an adverse event such as a fire. Common emergency exits include a latch-closed double door where both doors are mounted within a door frame, and a latch-closed single door mounted in a door frame. An exit device mounted to the door is typically used by individuals to exit the building through the emergency exit. Different types of exit devices include panic bars, push pads, and pushbars. A pushbar is commonly located on a door at a convenient height for an individual to push when exiting through the door. When the door is locked, a latchbolt typically engages a rim latch roller strike, which prevents the door from opening. Depressing the pushbar actuates retraction of the latchbolt and disengagement from the strike, thereby allowing the door to be opened.

Although the pushbar exit device provides certain advantages for individuals exiting a building or moving from one area to another area within a building, the pushbar exit device can be considered by individuals who live or work in a building to be unnecessarily restrictive. To overcome this inconvenience, an individual who uses a door having a pushbar many times during a day may decide to prop the door open with a door stop. In other situations, if a large number of individuals use that same door during a day, the latch roller strike may be removed from the door frame. The absence of the latch roller strike, however, enables anyone (including unauthorized individuals) to enter the building or facility.

Current exit doors, including corridor doors, main doors, and room doors in buildings or facilities having pushbar exit devices are generally designed to provide easy exit through the door, but to prevent entry when the door is locked. In some pushbar exit devices, the position of the door is sensed by a sensor that determines a position of the latchbolt, which generally engages the door strike when the door is shut. If the door strike has been removed, however, the sensor may indicate that the door is locked even when it is not. Accordingly, a mechanism is needed to positively identify a security condition of the door in the event that a pushbar exit device has been "defeated."

SUMMARY

In one embodiment, there is provided a locking device for a door located at a door frame having a door strike.

In another embodiment, there is provided a locking device including a latchbolt assembly for a door located at a door frame. The locking device assembly includes a door strike assembly located at the door frame. The door strike assembly includes a magnetized ferromagnetic material. The latchbolt assembly is located at the door and includes a latchbolt and a magnetic field sensor, wherein the magnetic field sensor senses a magnetic field provided by the door strike assembly.

In still another embodiment, there is provided a door strike assembly located at a door frame configured to engage a locking mechanism located at a door. The door strike assembly includes a strike frame and a rod, wherein one of the strike frame and the rod includes a magnetized ferromagnetic material configured to provide a magnetic field.

In a further embodiment, there is provided a method of identifying a security condition of a door including an attached latchbolt assembly. The method includes: providing a door strike assembly configured to engage the latchbolt assembly, wherein the door strike assembly is configured to be located at a door frame; generating a magnetic field with the door strike assembly; sensing the presence or absence of the generated magnetic with the latchbolt assembly; and providing an alert in the absence of the generated magnetic field.

Further embodiments, forms, features, and aspects of the present application shall become apparent from the description and figures provided herewith.

BRIEF DESCRIPTION OF THE FIGURES

The concepts described herein are illustrative by way of example and not by way of limitation in the accompanying figures. For simplicity and clarity of illustration, elements illustrated in the figures are not necessarily drawn to scale. Where considered appropriate, references labels have been repeated among the figures to indicate corresponding or analogous elements.

DETAILED DESCRIPTION OF ILLUSTRATIVE EMBODIMENTS

Figure 1:
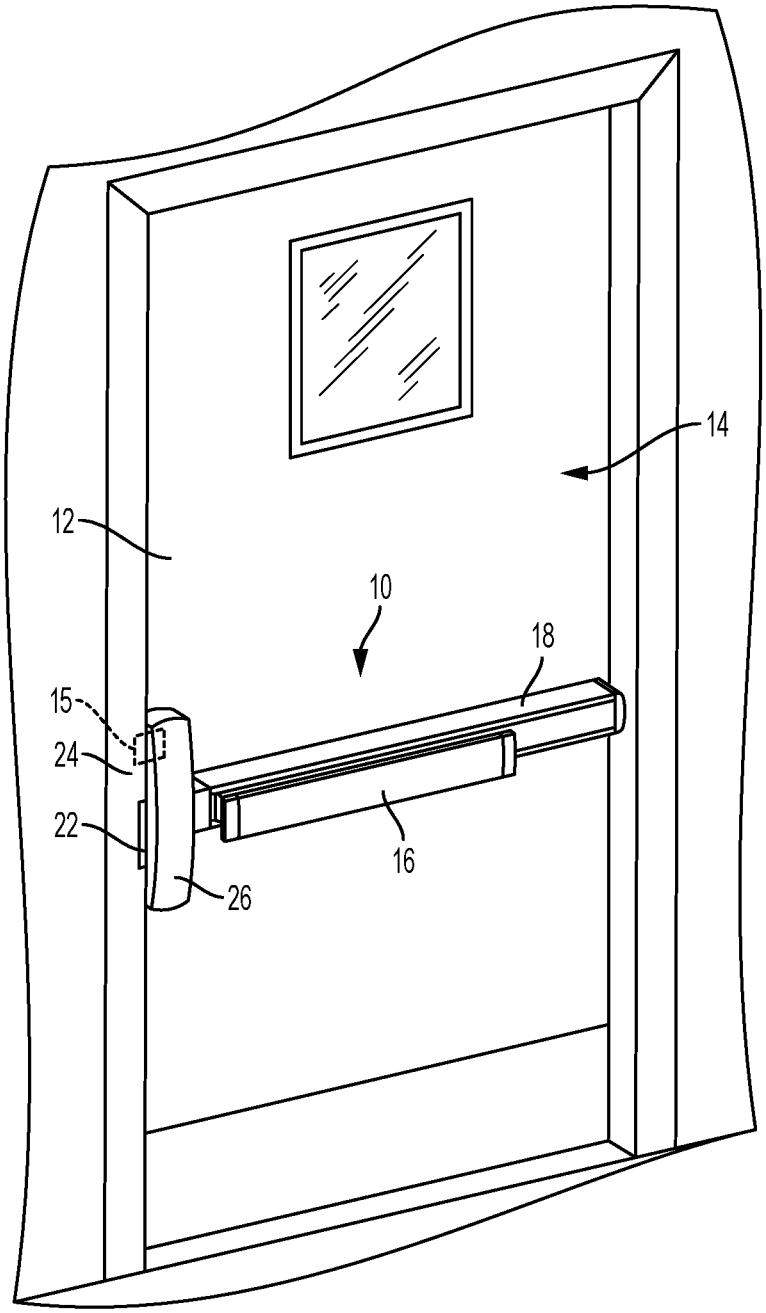
FIG. 1 illustrates an exit device according to at least one embodiment, as mounted on a door.

For the purposes of promoting an understanding of the principles of the invention, reference will now be made to the embodiments illustrated in the drawings and specific language will be used to describe the same. It will nevertheless be understood that no limitation on the scope of the invention is hereby intended. Any alterations and further modifications in the described embodiments, and any further applications of the principles of the invention as described herein are contemplated as would normally occur to one skilled in the art to which the invention relates.

Figure 2:
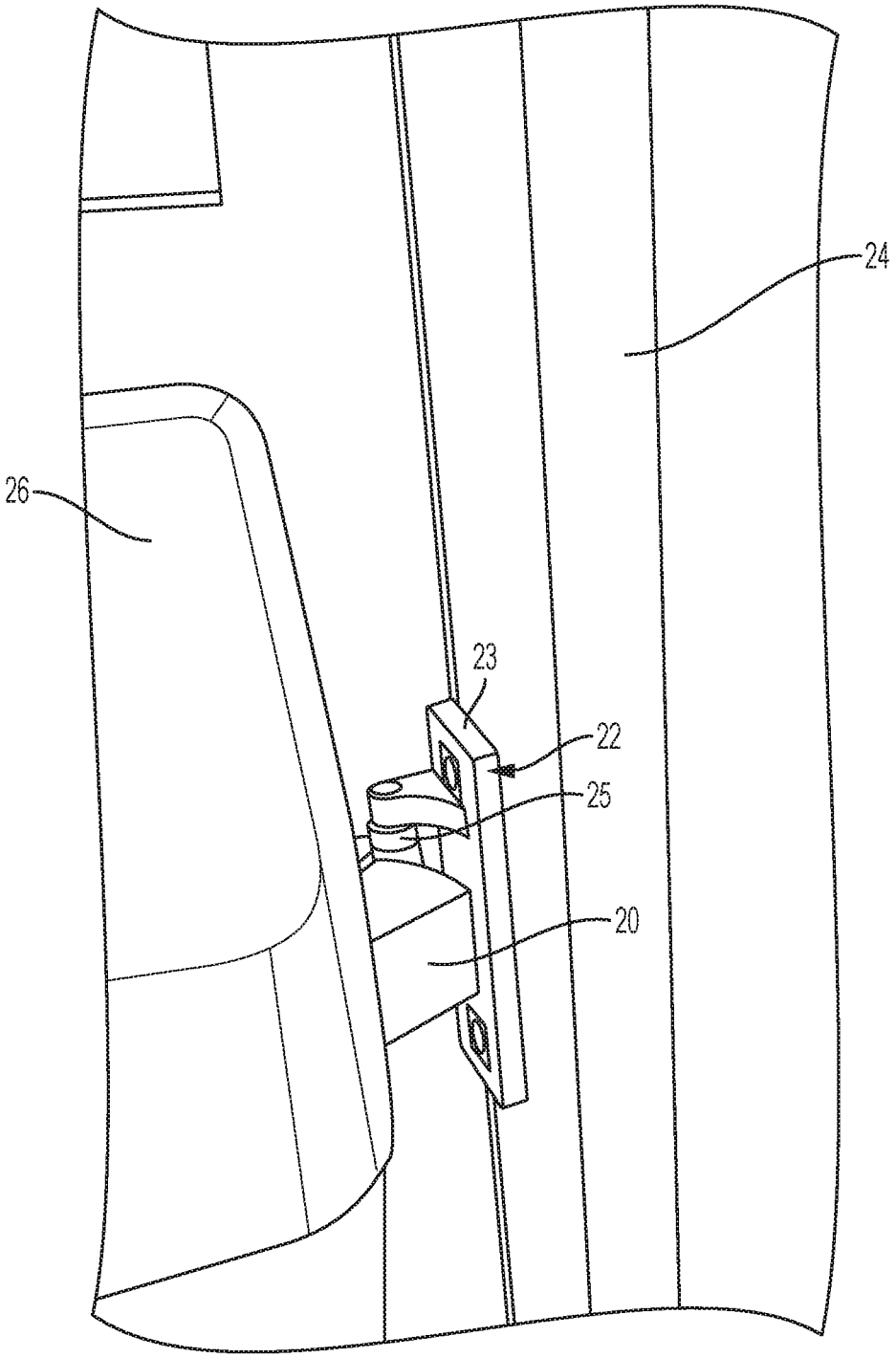
FIG. 2 illustrates a portion of the exit device including a pushbar assembly attached to a door and a door strike assembly attached to a door frame.

FIGS. 1 and 2 illustrate at least one embodiment of a locking device 10. The illustrative locking device 10 is mounted on an inside surface 12 of a door 14 and is configured for locking and unlocking the door 14. The door 14 can generally be utilized as an emergency exit or fire exit in a building or room. However, it should be appreciated that other types of doors and applications of the locking device 10 are also contemplated as falling within the scope of the invention. In some embodiments, the locking device 10 may be configured as an exit device that remains locked when a pushbar 16 is positioned in an extended or released position with respect to a housing 18 of the exit device, thereby preventing a person from accessing or opening the door 14 from the other side of the door 14 (i.e., the unsecure side). To unlock the door 14 from the inside (i.e., the secure side), a user pushes, actuates, or moves the pushbar 16 to a depressed or contracted position with respect to the housing 18. Pressing the pushbar 16 actuates a locking mechanism to unlock the door 14 as described in greater detail below.

In the illustrated embodiment, a latchbolt 20 is operably connected to a locking mechanism of the locking device 10, and extends from the locking device 10 to lock and unlock the door 14 (see, for example, FIG. 2). The door 14 is locked when the latchbolt 20 extends from the locking device 10 and is placed against a door strike assembly 22 located at a door frame 24. In the illustrative embodiment, the door strike assembly 22 is a surface mount door strike. Further, the door strike 22 assembly includes a strike frame 23, a rod or roller 25 rotatably supported by the strike frame 23, and a magnetized ferromagnetic material that generates a magnetic field.

Figure 3:
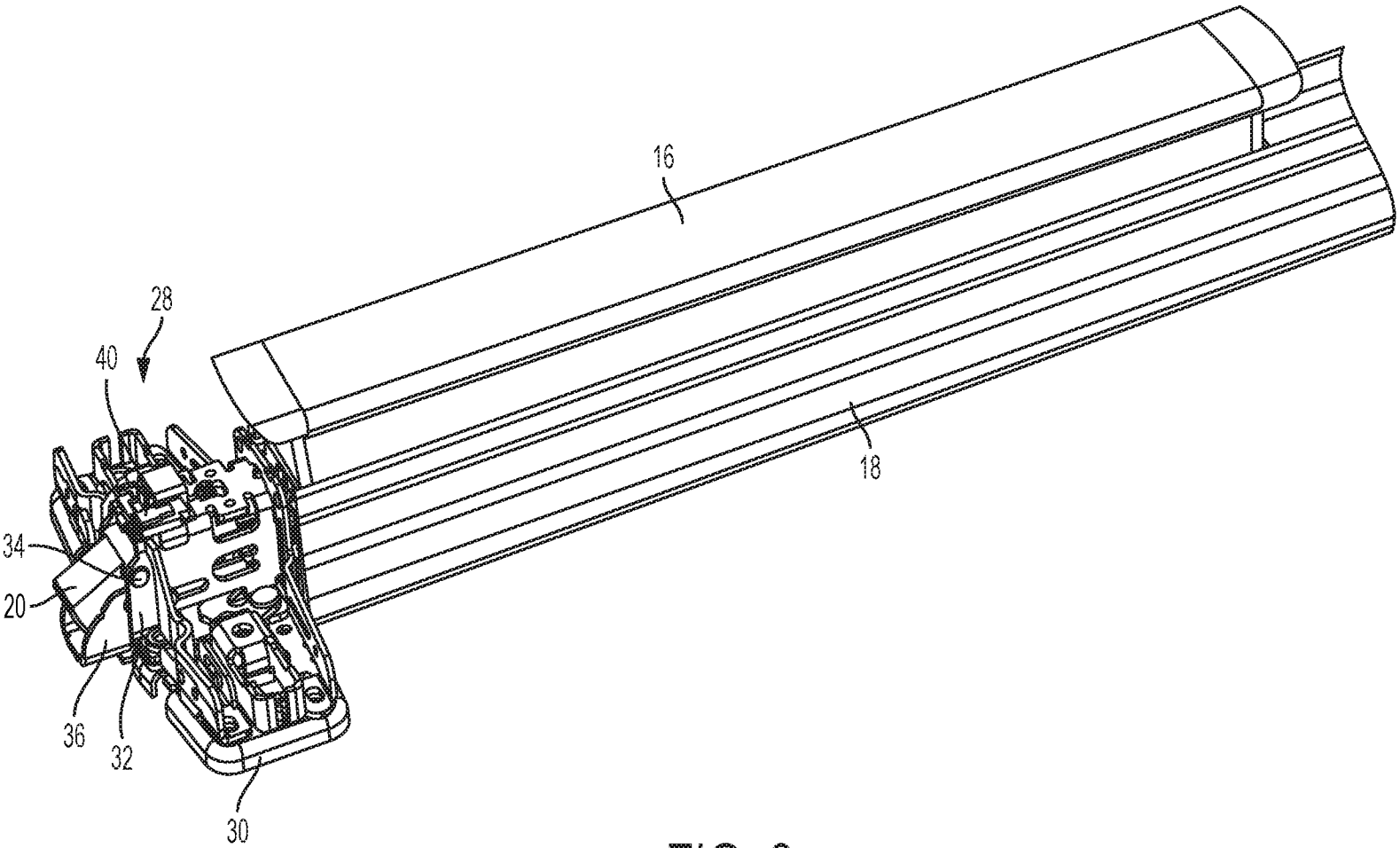
FIG. 3 illustrates a perspective view of a pushbar assembly with a housing removed.
Figure 4:
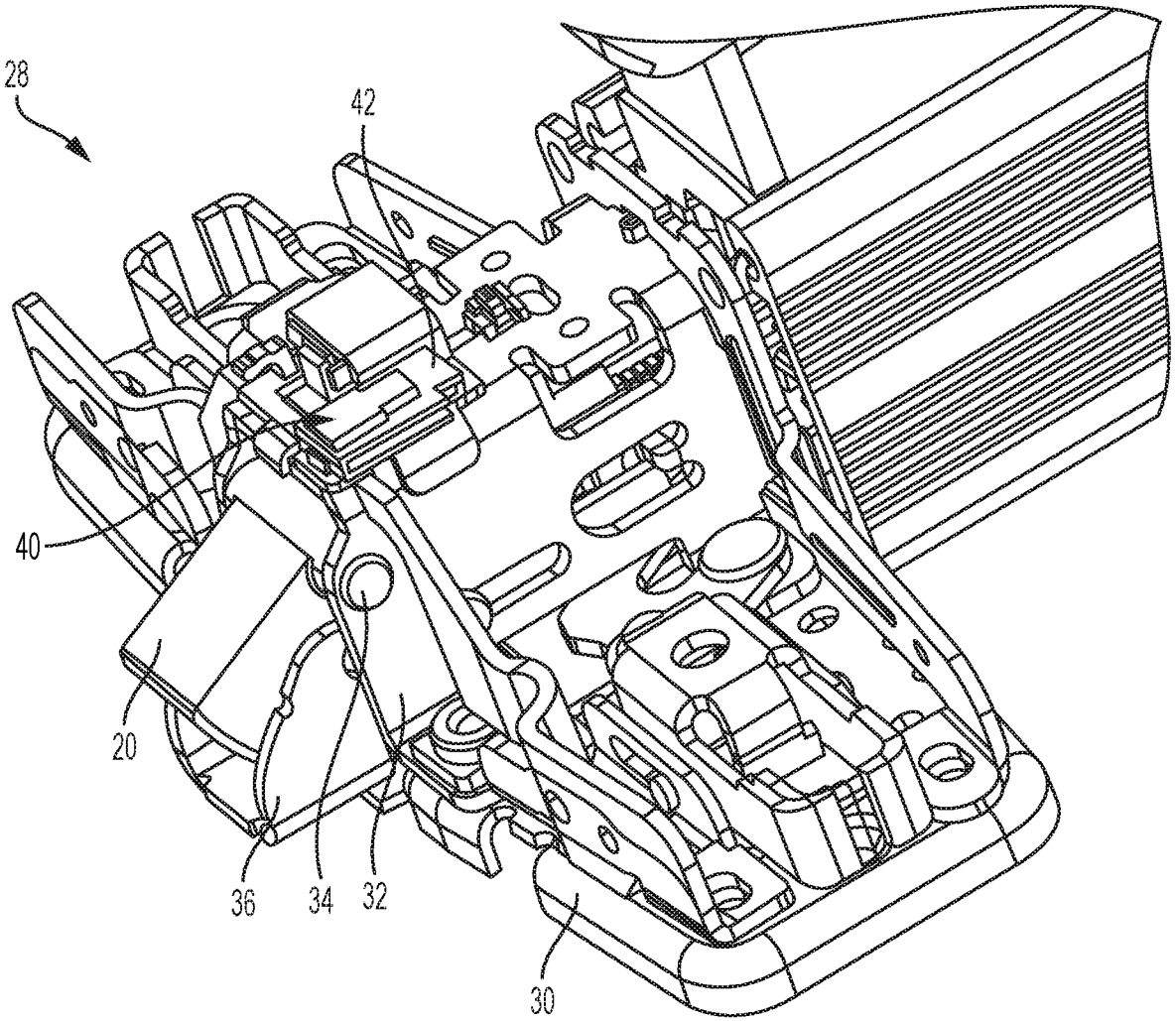
FIG. 4 illustrates a perspective view of a latchbolt assembly including a magnetic field sensing device.

The door 14 is unlocked by a user depressing the pushbar 16 toward the housing 18 and consequently toward the door 14. Pushing or depressing the pushbar 16 actuates the locking mechanism to retract the latchbolt 20, while at the same time supplying a force to move the door from the closed position to the open position. The locking mechanism is covered by a locking mechanism housing 26. The latchbolt assembly 28 further includes a magnetic sensing assembly 40 mounted to the mounting bracket 32 which is attached to a mounting plate 30, as illustrated in FIGS. 3 and 4. By depressing the pushbar 16 toward the door 14, the latchbolt 20 is rotatably moved about a pin 34 in a direction toward the housing 18, and an auxiliary latchbolt 36 is slidingly retracted toward the housing 18. Depressing the pushbar 16 therefore moves both the latchbolt 20 and the auxiliary latchbolt 36 away from the door strike 22 to enable the door to be opened.

As further illustrated in FIG. 4, the magnetic sensing assembly 40 includes a housing 42, which is configured to hold a magnetic sensing device configured to sense a magnetic field provided by a permanent magnet located at the door strike 22. In some embodiments, the magnetic sensing device is either a two axis magnetometer or a three axis magnetometer. In another embodiment, the magnetic sensing device is embodied as, or includes, a microelectromechanical systems (MEMS) chip including a magnetometer and an accelerometer. For example, in some embodiments, the use of a MEMS chip available from NXP Semiconductors, Eindhoven, The Netherlands, is contemplated. In some embodiments, the magnetometer is electrically coupled to a printed circuit board located within the housing.

The circuit board, electrically coupled to the magnetometer, is configured to locate, contain, and implement the magnetometer functionality circuit. In one embodiment, the magnetometer is an integrated circuit electrically coupled to a printed circuit board including, but not limited to other integrated circuits and discrete electrical components. In other embodiments, the circuit board includes or facilitates electrical communication circuitry for the magnetometer, processing circuitry such as a microprocessor, and associated memory. In different embodiments, the communication circuitry is wired, wireless, or a combination of wired and wireless communication circuitry.

The illustrative magnetic sensing assembly 40 is operatively connected to a controller 43 later described in reference to FIG. 8, which is configured to determine a security condition of the locking device 10. The door strike assembly 22, which is configured to engage the latchbolt assembly 28, generates a magnetic field that is sensed by the magnetic sensing assembly 40 or, more specifically, the magnetic sensing device. If the magnetic sensing device does not sense a magnetic field, the absence of the magnetic field indicates the presence of a security condition, including that the door strike assembly 22 is missing. More specifically, on security condition may indicate that the door strike assembly is not installed in the first place or is improperly installed. Another security condition may indicate that the door strike assembly 22 has been removed after installation to enable individuals to enter a room or facility through a locked side of the door. In either these conditions, it should be appreciated that the locking device is defeated and does not operate as intended. In another embodiment, a magnetic field may be sensed but is sufficiently low to indicate that a security condition exists.

Figure 5:
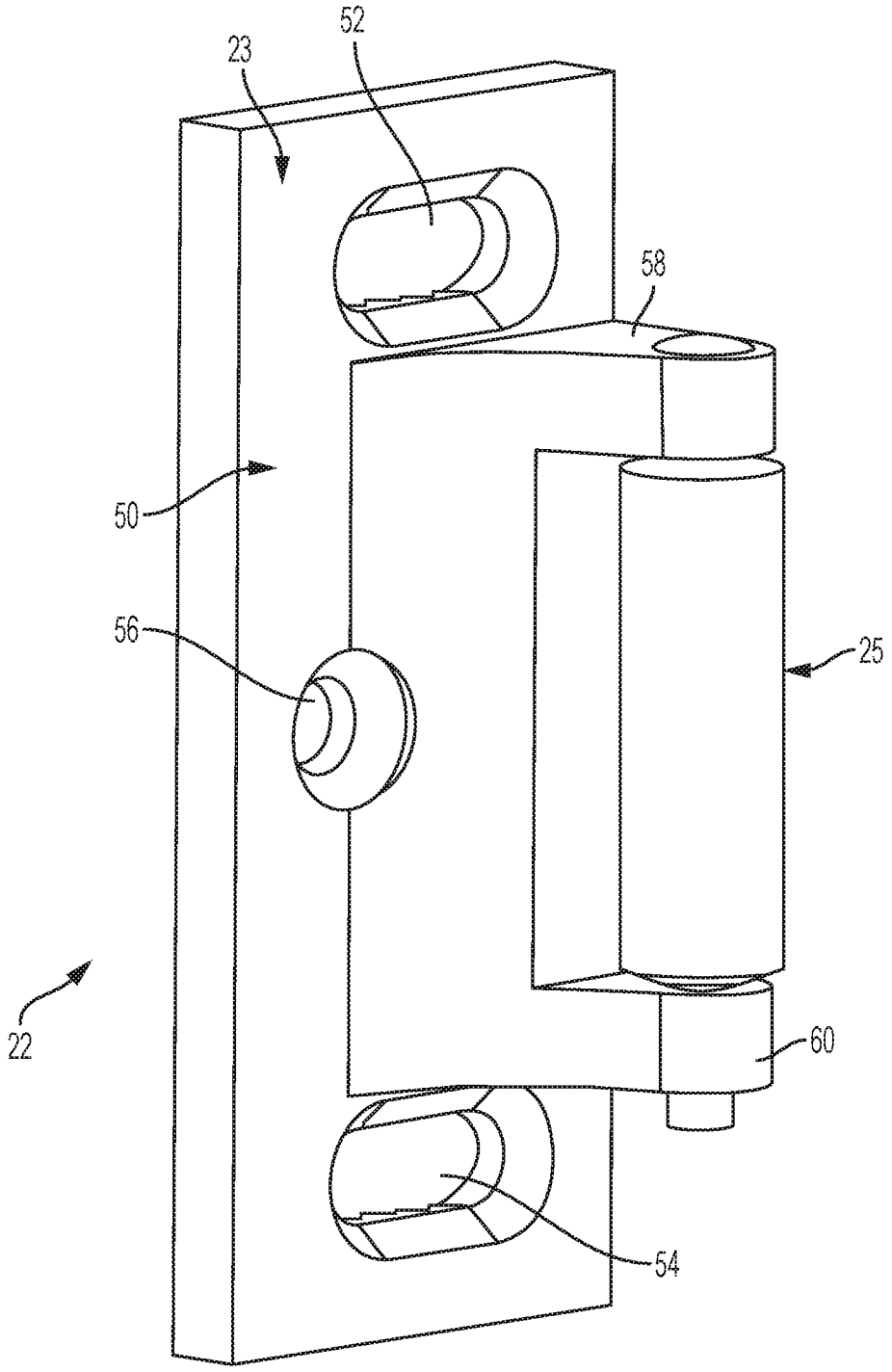
FIG. 5 illustrates a perspective view of a front side of a door strike assembly.

FIG. 5 illustrates at least one embodiment of a front side of the door strike assembly 22 including the strike frame 23 and the roller 25. As shown, the illustrative door strike assembly 22 includes a base 50 having a generally rectangular perimeter. However, it should be appreciated that the base 50 may be otherwise shaped in other embodiments. In the illustrative embodiment, the base 50 includes a first alignment aperture 52 and a second alignment aperture 54, which are generally oblong and which extend through the base to provide access for a screw or the other fastener/connector to attach the door strike assembly 22 to the door frame. Because each of the apertures 52 and 54 is oblong, the location of the illustrative door strike assembly 22 is adjustable from side to side to align the roller 25 with the latchbolt 20 during installation of the locking device 10. In addition, such an adjustment may be used in different embodiments to align the magnetic sensing assembly 40 with the magnetic field provided by the door strike assembly 22. Once the assembly is aligned, the connectors extending through the apertures 52 and 54 are set and an additional connector is inserted through an aperture 56 to complete the installation of the assembly 22. Although the illustrative door strike assembly 22 is described as being secured to the door frame by virtue of screws/fasteners and apertures defined in the base 50 of the door strike assembly 22, it should be appreciated that the door strike assembly 22 may be otherwise secured to the door frame in other embodiments.

As shown in FIG. 5, the illustrative door strike assembly 22 includes a first arm 58 and a second arm 60 that are connected to (e.g., integrally formed with) and extend from the base 50. Each of the first and second arms 58 and 60 includes a terminating end that rotatably supports a corresponding first and second end of the roller 25. As described herein, the roller 25 is configured to engage the latchbolt 20 and auxiliary latchbolt 36 to prevent opening of the door 14 when the latchbolt 20 is extended.

Figure 6:
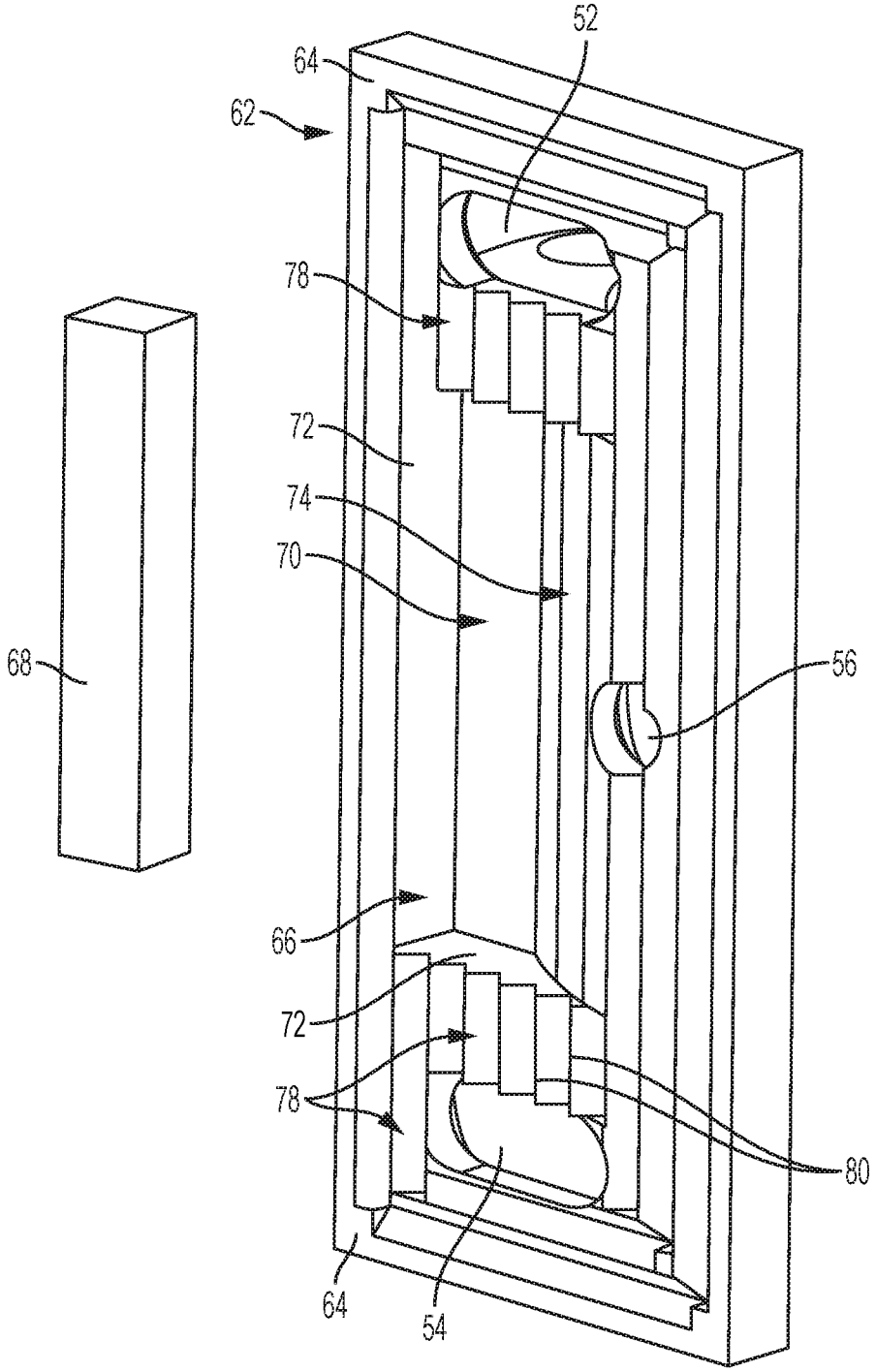
FIG. 6 illustrates a perspective view of a back side of a door strike assembly.

FIG. 6 illustrates at least one embodiment of a back side 62 of the door strike assembly 22. The back side 62 includes a wall 64 that extends about a perimeter of the back side 62 and defines a plane. As shown, the illustrative door strike assembly 22 includes a cavity 66 that is recessed from the plane to define a compartment that captures a magnetized ferromagnetic device 68, such as a permanent magnet, which is shown displaced from the cavity 66. In the illustrative embodiment, the magnetized ferromagnetic device 68 includes a length, a width, and a depth (and/or other relevant dimensions) sized to fit within the cavity 66 such that the magnet does not extend beyond the plane defined by the wall 64. In another embodiment, the magnetized ferromagnetic device 68 may extend beyond the plane and the portion that extends beyond the plane may be captured in the cavity defined in the door frame. Depending on the particular embodiment, the magnetized ferromagnetic device 68 may fit snugly or loosely within the cavity 66. In some embodiments, the base 50 and the first and second arms 58 and 60 are made of non-ferrous materials, for example, to enable the magnetic flux of the magnetized ferromagnetic device 68 to be relatively unimpeded by the strike frame 23.

The illustrative cavity 66 includes a bottom 70 and sides 72. In the illustrative embodiment, the sides 72 are generally perpendicular to the plane defined by the wall 64 and interface with sides of the magnetized ferromagnetic device 68. In some embodiments, an inclined side 74 extends generally from the wall 64 to the bottom 70 and facilitates the insertion and removal of the magnetized ferromagnetic device 68 into the door strike assembly 22. In the event the magnetized ferromagnetic device 74 has a magnetic field that is insufficient (e.g., in magnitude) to be detected by the magnetic sensing device 40, the inclined side 74 may facilitate removal of the magnetized ferromagnetic device 68 for replacement with a new magnetized ferromagnetic device (e.g., a different permanent magnet).

The back side 62 of the illustrative door strike assembly 22 further includes a plurality of channels 78 defined by inclined sides that define peaks 80. In some embodiments, the peaks 80 terminate at the plane defined by the wall 64. In other embodiments, the peaks 80 extend beyond the plane and/or are located "below" the plane. In some embodiments, the channels 78 may be configured to prevent the door strike assembly 22 from "sticking" to the surface to which the assembly is attached.

Figure 7:
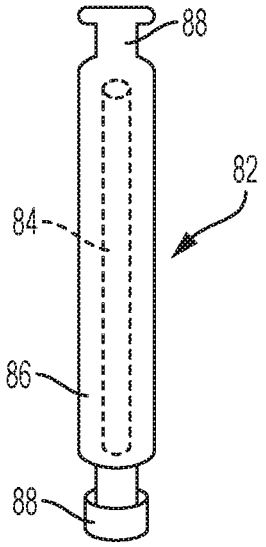
FIG. 7 illustrates at least one embodiment of a roller of a door strike assembly.

In the embodiment of FIG. 5, the roller 25 includes a material having sufficient strength to repeatably engage the latchbolt 20, as is understood by one skilled in the art. Depending on the particular embodiment, it should be appreciated that the roller 25 may include a ferrous material and/or a non-ferrous material. For example, in some embodiments, the roller 25 may be embodied as a roller similar to the roller 82 described in reference to FIG. 7. As shown in FIG. 7, the illustrative roller 82 includes a magnetized ferromagnetic insert 84. In this embodiment, the insert 84 fits within a cavity defined in the interior of a sleeve 86. The roller 82 includes ends 88 configured to be supported by the first arm 58 and second arm 60.

Figure 8:
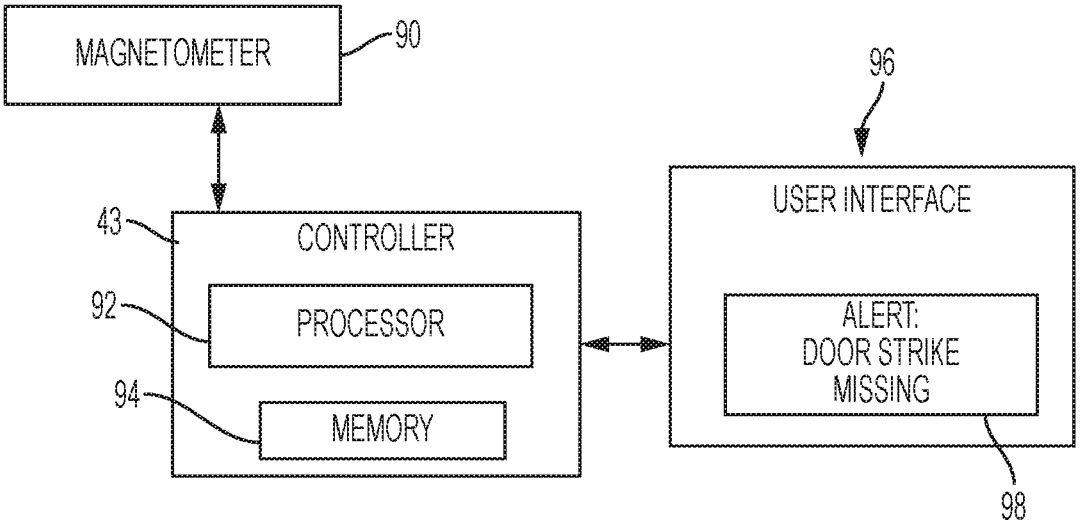
FIG. 8 illustrates a control system for determining the occurrence of an alert condition identified by an exit device.

In FIG. 8, a magnetometer 90, located at the magnetometer assembly 40, is operatively connected through a circuit board, not shown, to a controller 43 including a processor 92 configured to determine the presence, absence, or magnitude of a magnetic field provided by the door strike assembly 22. The magnetometer 90 generates a signal indicating the presence of a magnetic field, or a signal indicating the magnitude of a magnetic field, which is transmitted to the processor 92, and which in conjunction with a memory 94, provides a signal to a user interface 96 configured to indicate the presence or absence of a sensed magnetic field. The user interface 96, in some embodiments, includes a display portion 98 to indicate a security condition of the door 14. For example, the security condition shown in FIG. 8 indicates that the door strike is missing. In this condition, the magnetic field is sufficiently low such that the signal generated by the magnetometer and received by the processor 92 indicates that the door strike is missing. In another embodiment, the processor 92 is configured to determine the strength of the magnetic field provided by the magnetometer 90. In this embodiment, the alert indicates that the magnet is losing strength. In one or more embodiments, the magnetic field sensor includes an adjustable magnetic field sensitivity or the controller 43 is configured to determine an intensity of the magnetic field sensor. In other embodiments, the magnetic field sensor includes a detection range, wherein the detection range includes first range in which a magnetic field provided by the magnetized ferromagnetic material is detected and a second range in which a magnetic field provided by the magnetized ferromagnetic material is not detected.

The memory 94 is a non-transitory computer readable medium having data stored thereon, and is in communication with the processor 92. The data stored on the memory 94 may include, for example, one or more sets of instructions, one or more look-up tables, and/or additional data. The instructions are executed, when required, by the processor 92 to cause the processor 92 to perform one or more functions such as, for example, the functions described herein. The controller 43, in different embodiments, is housed within the locking device 10 or is located externally to the locking device 10.

The processor 92 in different embodiments, is a programmable type, a dedicated, hardwired state machine, or a combination of these, and can further include multiple processors, Arithmetic-Logic Units (ALUs), Central Processing Units (CPUs), Digital Signal Processors (DSPs) or the like. Other forms of processor 92 include multiple processing units, distributed, pipelined, and/or parallel processing. The processor 92, in different embodiments, is dedicated to performance of the operations described herein or is utilized in one or more additional operations or applications. In the depicted form, the processor 92 is of a programmable variety that executes algorithms and processes data in accordance with defined by programmed instructions (such as software or firmware) stored in memory 94. Alternatively or additionally, the operating logic for processor 92 is at least partially defined by hardwired logic or other hardware. The processor 92, in different embodiments, is comprised of one or more components of any type suitable to process the signals received from the magnetometer 90, and provides desired output signals. Such components may include digital circuitry, analog circuitry, or a combination of both.

The memory 94 includes one or more types, such as a solid-state variety, electromagnetic variety, optical variety, or a combination of these forms. Furthermore, the memory 94 includes, in different embodiments, volatile, nonvolatile, or a combination of these types, and a portable variety, such as a disk, tape, memory stick, cartridge, or the like. In addition, the memory 94 is configured to store data that is manipulated by the operating logic of the processor 92, for example, such as data representative of signals received from and/or sent to the locking device 10 in addition to or in lieu of stored program instructions.

In other embodiments, the magnetic door strike assembly 22 is used in conjunction with a door position sensing (DPS) system 15, which is configured to determine the position of the door 14 with respect to the door frame 24. If the door is closed in a DPS system lacking the door strike assembly 22, the DPS may indicate that the door is closed, but will not indicate that the door is unlocked due to the lack of the magnetic door strike assembly 22. By including the magnetic door strike assembly 22, the condition where the surface mounted door strike has been removed either intentionally, or by theft, eliminates the condition of a falsely secured entryway.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described. Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected.

What is claimed is:

1. A locking device assembly for a door located at a door frame, the locking device assembly comprising:

a door strike assembly located at the door frame, the door strike assembly including a magnetized ferromagnetic material; and a latchbolt assembly located at the door, the latchbolt assembly includes a latchbolt and a magnetic field sensor;

wherein the door strike assembly includes a strike frame having a back wall mounted to the door frame, wherein the door strike assembly includes a rod offset from the strike frame and configured to engage the latchbolt when the door is in a closed position, and wherein the strike frame defines a cavity with the magnetized ferromagnetic material positioned in the cavity and located between the back wall and the rod;

wherein the magnetized ferromagnetic material of the door strike assembly generates a magnetic field that is aligned with the magnetic field sensor when the latchbolt assembly is located in a position relative to the door strike assembly;

wherein the magnetic field sensor senses the magnetic field generated by the magnetized ferromagnetic material of the door strike assembly, and thereby provides a status indication that the latchbolt assembly is located in the position relative to the door strike assembly in which the latchbolt engages the rod of the door strike assembly; and wherein when the magnetic field sensor does not sense a sufficient magnitude of the magnetic field generated by the magnetized ferromagnetic material, an alert indication is provided to thereby indicate that the latchbolt assembly is not located in the position relative to the door strike assembly in which the latchbolt engages the rod of the door strike assembly.

2. The locking device assembly of claim 1, wherein the magnetized ferromagnetic material of the door strike assembly is aligned with the latchbolt assembly when the latchbolt is engaged with the rod of the door strike assembly.

3. The locking device assembly of claim 1, wherein the strike frame includes a front portion configured to support the rod, and wherein the back wall defines an opening to provide access to the cavity.

4. The locking device assembly of claim 1, wherein the magnetized ferromagnetic material is entirely located within the cavity in the strike frame.

5. The locking device assembly of claim 1, wherein the magnetic field sensor includes a detection range, wherein the detection range includes a first range in which the magnetic field generated by the magnetized ferromagnetic material is sensed and a second range in which the magnetic field generated by the magnetized ferromagnetic material is not sensed.

6. The locking device assembly of claim 1, wherein the magnetic field sensor includes an adjustable magnetic field sensitivity.

7. The locking device assembly of claim 1, further comprising a door position sensor configured to determine a position of the door relative to the door frame.

8. The locking device assembly of claim 1, wherein the alert indication indicates that the door strike assembly is improperly installed or has been removed from the door frame.

9. The locking device assembly of claim 1, wherein the magnetized ferromagnetic material is located directly behind the rod of the door strike assembly.

10. The locking device assembly of claim 1, wherein the strike frame includes an inclined surface extending from the back wall to facilitate insertion or removal of the magnetized ferromagnetic material into/from the cavity.

11. The locking device assembly of claim 1, wherein the back wall of the strike plate includes a plurality of channels and peaks to facilitate disengagement of the strike frame from the door frame.

12. A door strike assembly located at a door frame configured to engage a locking mechanism located at a door, the door strike assembly comprising:

a strike frame having a back wall mounted to the door frame; and a rod offset from the strike frame;

wherein the locking mechanism includes a latchbolt aligned with the strike frame and configured to engage the rod based on a position of the locking mechanism relative to the door strike assembly;

wherein the strike frame defines a cavity with a magnetized ferromagnetic material positioned in the cavity and located between the back wall and the rod;

wherein the magnetized ferromagnetic material generates a magnetic field that is aligned with a magnetic field sensor when the locking mechanism is located in the position relative to the door strike assembly;

wherein the magnetic field sensor senses the magnetic field generated by the magnetized ferromagnetic material, and thereby provides a status indication that the locking mechanism is located in the position relative to the rod in which the latchbolt can engage the rod; and wherein when the magnetic field sensor does not sense a sufficient magnitude of the magnetic field generated by the magnetized ferromagnetic material, an alert indication is provided to thereby indicate that the locking mechanism is not located in the position relative to the rod in which the latchbolt can engage the rod.

13. The door strike assembly of claim 12, wherein the strike frame includes a front portion configured to support the rod, and wherein the back wall defines an opening to provide access to the cavity.

14. The door strike assembly of claim 12, wherein the magnetized ferromagnetic material is entirely located within the cavity in the strike frame.

15. The door strike assembly of claim 12, further comprising a door position sensor configured to determine a position of the door relative to the door frame.

16. The door strike assembly of claim 12, wherein the alert indication indicates that the door strike assembly is improperly installed or has been removed from the door frame.

17. A method of identifying a security condition of a door including an attached latchbolt assembly including a latchbolt, the method comprising:

providing a door strike assembly configured to engage with the latchbolt of the latchbolt assembly, wherein the door strike assembly is configured to be located at a door frame, wherein the door strike assembly includes a strike frame having a back wall mounted to the door frame, wherein the door strike assembly includes a rod offset from the strike frame and configured to engage the latchbolt when the door is in a closed position, and wherein the strike frame defines a cavity with a magnetized ferromagnetic material positioned in the cavity and located between the back wall and the rod;

generating a magnetic field with the magnetized ferromagnetic material of the door strike assembly;

sensing a presence of the generated magnetic field with a magnetic field sensor, and thereby providing a status indication that the latchbolt assembly is in a position relative to the door strike assembly in which the latchbolt can engage with the rod; and providing an alert indication based on an electronic signal generated by the magnetic field sensor when a sufficient magnitude of the generated magnetic field is not sensed by the magnetic field sensor to thereby indicate that the latchbolt assembly is not located in the position relative to the door strike assembly in which the latchbolt can engage with the rod.

18. The method of claim 17, wherein the magnetized ferromagnetic material that generates the magnetic field is located directly behind the rod of the door strike assembly.

19. The method of claim 17, wherein the alert indication is displayed on a user interface.

20. The method of claim 17, wherein the sensing step is accomplished using a magnetometer located adjacent to the latchbolt of the latchbolt assembly.

21. The method of claim 17, further comprising providing a door position sensor, and sensing a position of the door relative to the door frame.

22. The method of claim 17, wherein the alert indication indicates that the door strike assembly is improperly installed or has been removed from the door frame.

* * * * *